US005297768A

United States Patent [19]

Denton

[11] Patent Number: 5,297,768

[45] Date of Patent: Mar. 29, 1994

[54] UNIVERSALLY ADJUSTABLE COPYHOLDER

[75] Inventor: Frank Denton, 2965 Johnson Pl., Wantagh, N.Y. 11793

[73] Assignee: Frank Denton, Wantagh, N.Y.

[21] Appl. No.: 807,479

[22] Filed: Dec. 16, 1991

[51] Int. Cl.[5] ..... B41J 13/00

[52] U.S. Cl. ..... 248/442.2; 248/458; 248/279; 248/205.2

[58] Field of Search ..... 248/442.2, 454, 458, 248/103, 279, 316.7, 515, 540, 205.2, 307, 911, 912, 514; 400/718; 40/341

[56] References Cited

U.S. PATENT DOCUMENTS

| | | | |
|---|---|---|---|
| 363,142 | 5/1887 | Horton . | |
| 412,221 | 10/1889 | Allen . | |
| 1,181,537 | 5/1916 | Osborn | 400/718 X |
| 1,198,186 | 9/1916 | Brown . | |
| 1,251,147 | 12/1917 | Wesche | 248/514 |
| 1,494,212 | 5/1924 | Bromley . | |
| 1,615,959 | 2/1927 | Slavik . | |
| 1,841,770 | 1/1932 | Tharp | 248/454 |
| 2,876,359 | 3/1959 | Plymale . | |
| 3,998,421 | 12/1976 | Clemison | 248/441 B |
| 4,024,662 | 5/1977 | Krulwich | 40/352 |
| 4,074,453 | 2/1978 | Knox | 40/352 |
| 4,109,888 | 8/1978 | Hayes | 248/443 |
| 4,332,362 | 6/1982 | Leopold | 248/226.5 |
| 4,340,298 | 7/1982 | Toby | 355/75 |
| 4,466,593 | 8/1984 | Odenath | 248/455 |
| 4,466,596 | 8/1984 | Cohen | 248/635 |
| 4,546,947 | 10/1985 | Gesten | 248/442.2 |
| 4,569,498 | 2/1986 | Ermanski | 248/441.1 |
| 4,632,471 | 12/1986 | Visnapun | 312/233 |
| 4,682,749 | 7/1987 | Sträter | 248/284 |
| 4,702,453 | 10/1987 | Bishop | 248/447.2 |
| 4,747,572 | 5/1988 | Weber | 248/442.2 |
| 4,767,093 | 8/1988 | Jones | 248/442.2 |
| 4,836,489 | 6/1989 | Chu | 248/442.2 |
| 4,870,725 | 3/1989 | Dubowik | 248/205.2 X |
| 4,882,863 | 11/1989 | Gross | 40/352 |
| 4,934,648 | 6/1990 | Yueh | 248/442.2 |
| 4,957,261 | 9/1990 | Cirami | 248/454 |
| 4,958,453 | 9/1990 | Mangler et al. | 40/352 |
| 4,958,737 | 9/1990 | Auerbach | 206/557 |
| 5,035,393 | 7/1991 | Menaged | 248/456 |
| 5,067,681 | 11/1991 | Huang et al. | 248/316.7 X |
| 5,125,612 | 6/1992 | McNeal | 248/442.2 |

FOREIGN PATENT DOCUMENTS

| | | | |
|---|---|---|---|
| 371611 | 6/1923 | Fed. Rep. of Germany | 248/442.2 |
| 2102873 | 5/1981 | United Kingdom . | |
| 2228900 | 9/1990 | United Kingdom . | |

OTHER PUBLICATIONS

Pilot Corporation Advertisement (1988).
Wesystem Display Products Advertisement (1988).
Fellowes Advertisement (1989).
Acco International, Inc. Advertisement (1990).
Charles Leonard, Inc. Advertisement.
Nerac Industries Search No. 14 (Mar. 7, 1991).
Nerac Industries Search No. 1159 (Mar. 7, 1991).
Nerac Industries Search No. 1160 (Mar. 7, 1991).
Nerac Industries Search No. 1161 (Mar. 7, 1991).
Nerac Industries Search No. 1163 (Mar. 7, 1991).
Nerac Industries Search No. 1164 (Mar. 7, 1991).
Nerac Industries Search No. 1165 (Mar. 7, 1991).
Nerac Industries Search No. 3484 (Apr. 1, 1991).
Nerac Industries Search No. 2356 (Jun. 10, 1991).
Nerac Industries Search No. 4420 (Jun. 24, 1991).
Nerac Industries Search No. 6286 (Jul. 29, 1991).
Nerac Industries Search No. 6834 (Sep. 9, 1991).

*Primary Examiner*—Karen J. Chotkowski
*Attorney, Agent, or Firm*—Pennie & Edmonds

[57] ABSTRACT

A copyholder holds a sheet of paper in a predetermined position at a convenient work angle for viewing by a user and is easily attachable to and removable from a variety of work surfaces. The copyholder comprises front and rear elongated members, a base, fastening elements for supporting the elongated members upon the base, and several different mechanisms for providing movement to the copyholder in six different degrees of freedom for adjusting its position.

32 Claims, 6 Drawing Sheets

UNIVERSALLY ADJUSTABLE COPYHOLDER

BACKGROUND OF THE INVENTION

1. Field of the Invention

The present invention relates to a copyholder, and, in particular, to a copyholder that is universally adjustable so that a sheet of paper may be oriented at a comfortable viewing angle.

2. Description of the Prior Art

Copyholders are used on a daily basis by secretaries and other professionals involved in data entry and word processing to hold a sheet of paper in a substantially vertical position so that the information on the paper may be typed on a typewriter or stored in a computer. Normally, secretaries place the copyholder on their desk immediately beside their typewriter or computer while they work. Thus, they must sit with their body oriented toward the machine and with their head turned away from the machine and toward the copyholder to read the information on the paper.

Over time, sitting in this position becomes uncomfortable and causes severe neck and back aches. Further, secretaries must constantly focus and re-focus their eyes to compensate for the difference in distance between the copyholder and the computer screen. This constant re-focusing further exasperates the secretaries' discomfort because it causes eye strain and headaches.

These copyholders are also relatively large and occupy a great deal of space on a secretary's desk. Since most secretaries work on several different projects simultaneously, desk space is at a premium and they cannot afford to waste any of it with an unnecessarily large copyholder.

Thus, it would be advantageous if these copyholders were smaller and could be positioned closer to the machine. Prior art attempts at resolving this problem may be found, for example, in U.S. Pat. Nos. 4,836,489 to Chu ("the Chu Copyholder") and 4,934,646 to Yueh ("the Yueh copyholder").

However, merely positioning the copyholder closer to the machine does not solve the neck and back aches and eye strain experienced by the secretaries. During the day, secretaries need to change their seating position to remain comfortable, and changing lighting conditions require that the angle of the paper be adjusted to reduce glare. The Chu and Yueh copyholders, however, are deficient because the degrees of freedom available for adjusting the orientation of the copyholder is limited.

Further, the number of positions available in a work area to initially set up the copyholder is often very limited. Thus, flexibility in initially positioning the copyholder is required. However, the prior art copyholders do not adequately provide this flexibility.

Accordingly, there is a need for a copyholder that will occupy very little space in a work area, that may be mounted on horizontal, vertical or any other work surface, and that is universally adjustable so that a sheet of paper may be held at a comfortable viewing angle for a user.

SUMMARY OF THE INVENTION

In accordance with the present invention, there is provided a copyholder for positioning a sheet of paper at a desired viewing angle. The copyholder comprises means for holding a sheet of paper, first means for rotating the holding means in a first plane, second means operatively associated with the first means for rotating the holding means in a second plane which is angularly disposed with respect to the first plane, and means operatively associated with the first means for mounting the holding means in any one of a plurality of vertical positions.

BRIEF DESCRIPTION OF THE DRAWINGS

FIG. 9 is a front plan view of one mounting disk.

FIG. 10 is a cross-sectional view thereof taken along lines 10—10 of FIG. 9.

FIG. 11 is a front plan view of the other mounting disk.

FIG. 12 is a cross-sectional view thereof taken along lines 12—12 of FIG. 11.

DETAILED DESCRIPTION OF THE PREFERRED EMBODIMENTS

Figure 1:
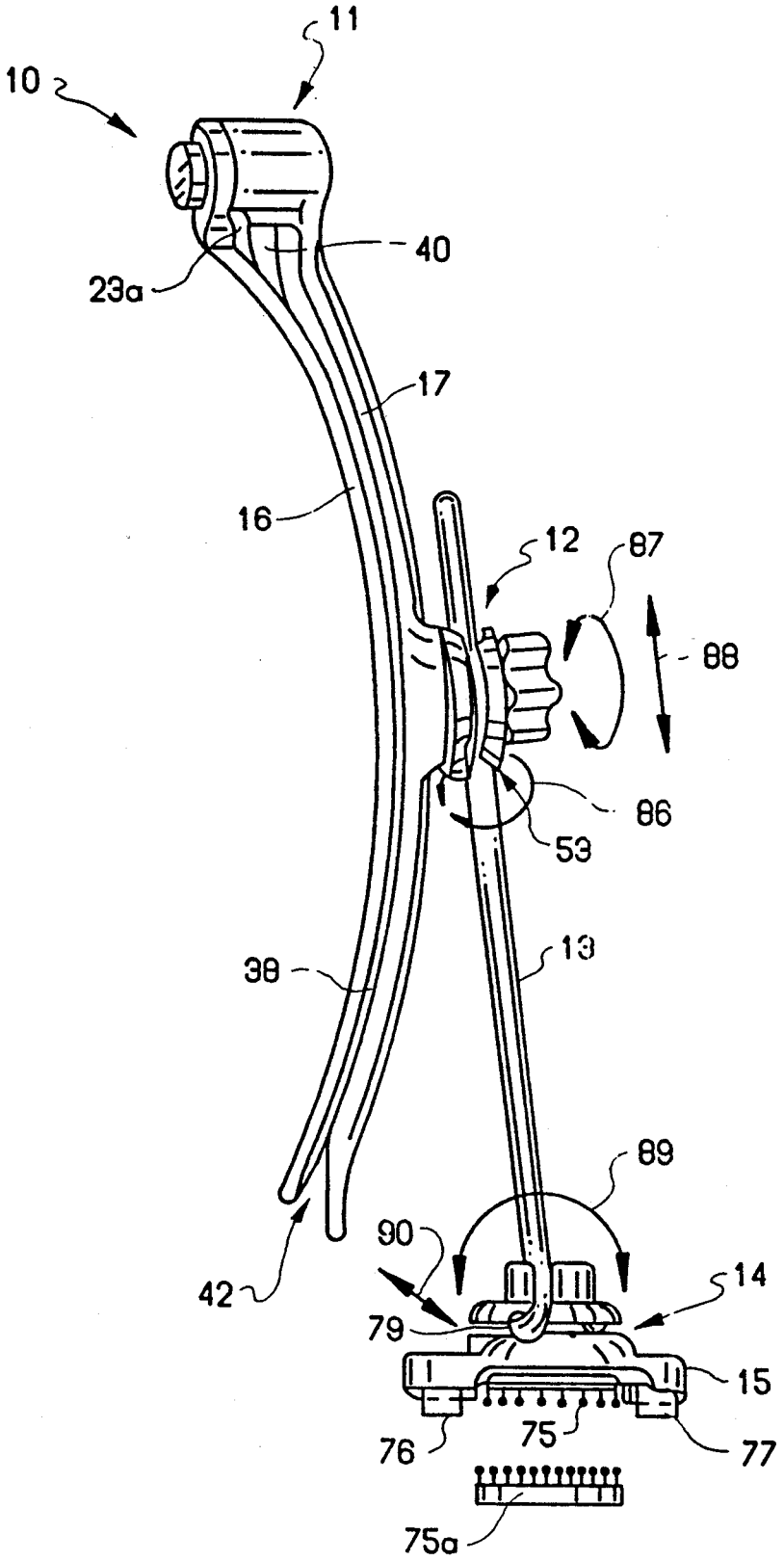
FIG. 1 is a perspective view of the copyholder of the present invention.
Figure 2:
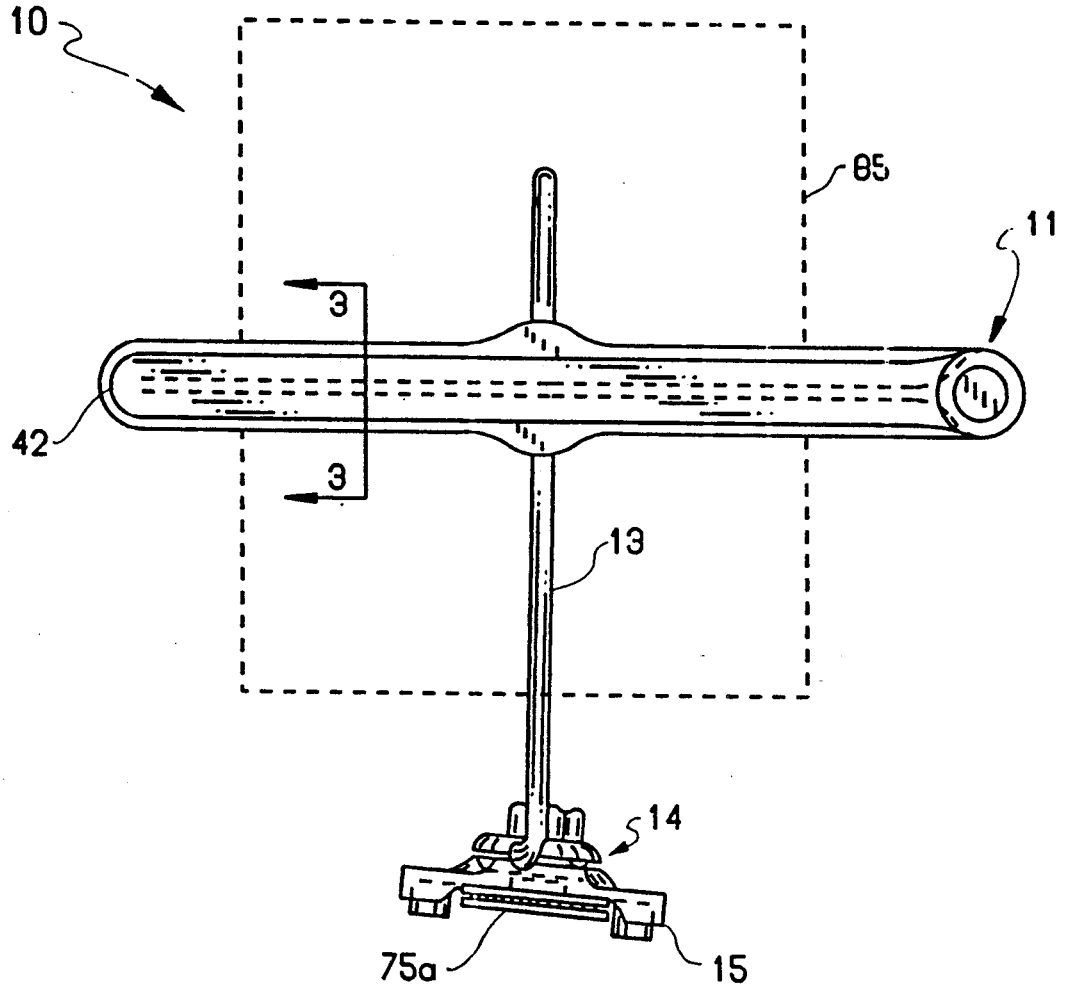
FIG. 2 is a front elevation view thereof.
Figure 3:
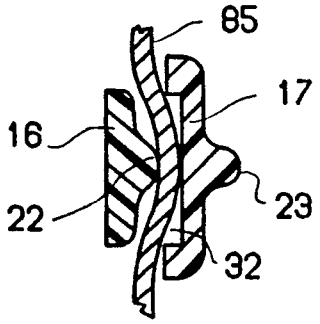
FIG. 3 is a cross-sectional view thereof taken along lines 3—3 of FIG. 2.

Referring to the drawings and particularly to FIGS. 1–4, there is illustrated a copyholder generally designated by the numeral 10 for holding a sheet of paper 85 so that the information stored thereon may be typed on a typewriter or computer keyboard.

Apparatus 10 generally comprises a paper holder 11, a mounting assembly 12, a vertical support member 13, a base connector assembly 14, and a base 15.

The paper holder 11 includes a pair of arcuately shaped elongated members 16, 17 which include a slot 38 therebetween for receiving and holding paper 85 or the like. The term "paper" is used herein to mean any relatively flat, thin object which contains illustrations, information or data thereon which must be viewed by a user and which is not capable of supporting itself in an upright position. Mounting assembly 12 connects the paper holder 11 to the vertical support member 13 in a manner which allows the holder 11 to rotate in two different planes as well as be moved vertically upward or downward. Vertical support member 13 is connected to base 15 by base connector assembly 14 in a manner which allows both tilting of member 13 and horizontal forward and rearward movement of member 13 with respect to base 15. In addition, base 15 can be removably attached to a support surface, such as a desk, computer, typewriter, shelf, etc. for the convenience of the user. Thus, the copyholder 10 of the present invention provides for at least 6 degrees of freedom so that paper 85 can be oriented in any one of a multitude of positions to facilitate viewing by the user.

FIGS. 4–8 illustrate the details of the paper holder 11. This component preferably comprises a front elongated member 16 and a rear elongated member 17. Front elongated member 16 is a relatively flat bar having an arcuate shape along a direction of curvature, a first end portion 16*a*, a second end portion 16*b*, and an arcuate body portion 16*c*. First end portion 16*a* includes a tubular extension 18 with a base portion 18*a* of greater diameter than tubular extension 18, a neck portion 19, and a connection portion 19*a* extending from one end of body portion 16*c*. Extension 18 is generally cylindrical in shape and has a bore 20 therethrough, while neck portion 19 is generally straight and extends to base portion 18*a* in a substantially perpendicular direction to the axis of extension 18. Connection portion 19*a* is also generally straight and extends at an oblique angle toward neck portion 19. Front surface 21 and rear surface 22 of front member 16 are generally flat, while rear surface 22 includes a rib 23 projecting therefrom. Rib 23 extends from extension 18 along neck portion 19, along the entire length of rear surface 22, and ends in a tapered portion 23*b* which tapers into rear surface 22 at second end portion 16*b*.

Rear elongated member 17 is also in the form of a flat bar having an arcuate shape along a direction of curvature, and the length and arcuate shape of rear elongated member 17 is substantially the same as and is complementary to the length and arcuate shape of front elongated member 16. Rear member 17 comprises a first end portion 17*a*, a second end portion 17*b*, a center portion 17*c*, an arcuate body portion 17*d*, a front surface 29, a rear surface 30, and center bore 31. Center Bore 31 is set in a square recess 31A, which in turn is set in a circular recess 31B.

First end portion 17*a* extends from center portion 17*c* and is attached to a tubular extension 24 by a short, straight neck portion 25 which projects in a substantially perpendicular direction to the axis of extension 24. Tubular extension 24 has an open end portion 26 and a closed end portion 27. Open end portion 26 has a notch 26' thereon which is configured and dimensioned to receive rib 23*a* therein, as described herein in detail. Closed end portion 27 comprises a bore 28 therethrough which is threaded. Tubular extension 24 is configured and dimensioned to receive tubular extension 18 therein.

Front surface 29 of rear member 17 includes a slightly depressed area or recess 32 therein. Preferably, recess 32 is at least as wide as front member 16 and as deep as one half the height of rib 23. Recess 32 receives rib 23 therein to securely retain paper 85 therebetween when the paper holder 12 is assembled.

Rear surface 30 is also generally smooth with a rib 34 protruding therefrom. Rib 34 extends along the entire length of rear surface 30, except for the area defined by center portion 17*c*. At this location, rib 34 branches off in two directions and encircles center bore 31, thereby defining a base portion 36 and peripheral edge 36'.

Figure 4:
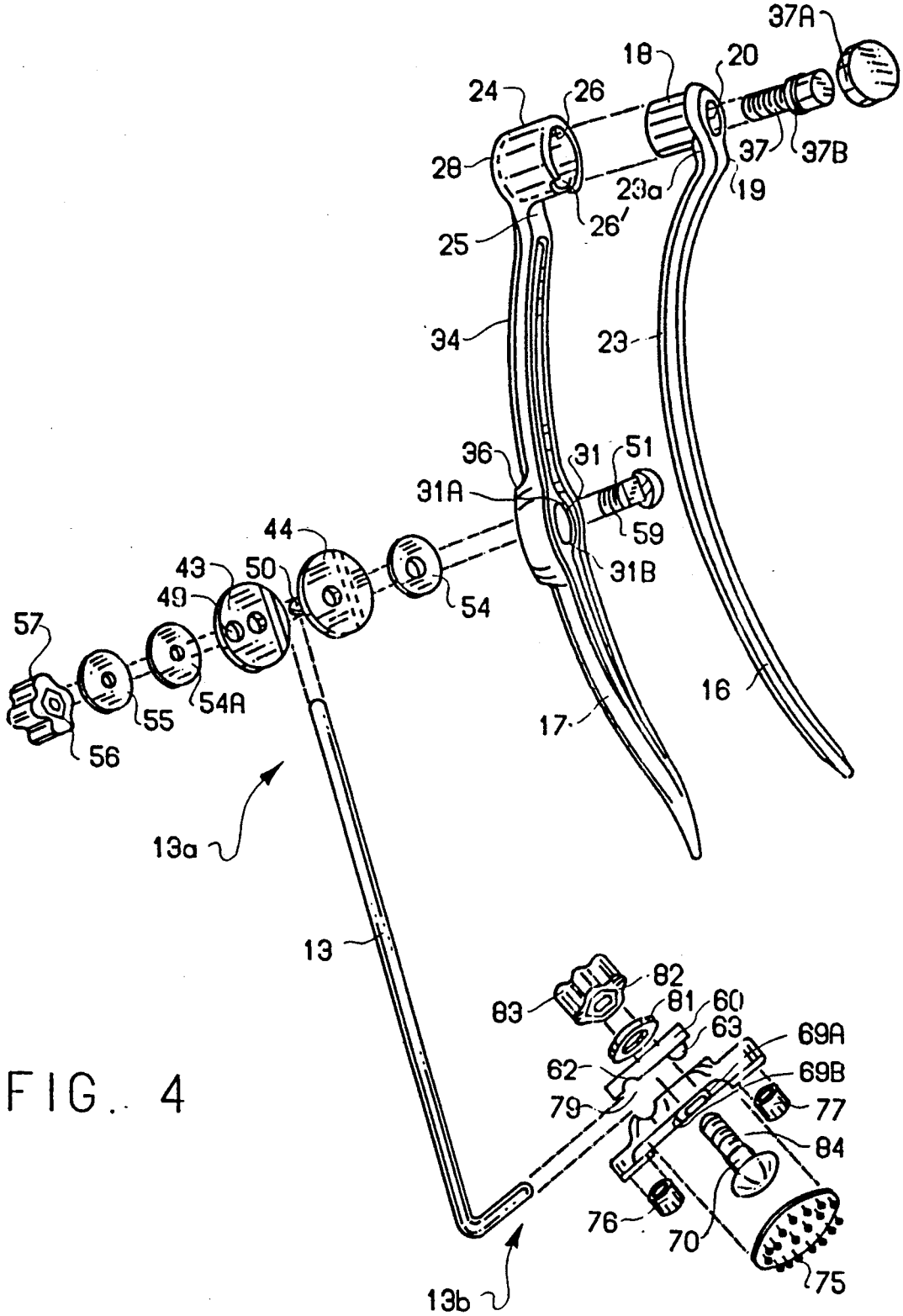
FIG. 4 is an exploded perspective view thereof.
Figure 5:
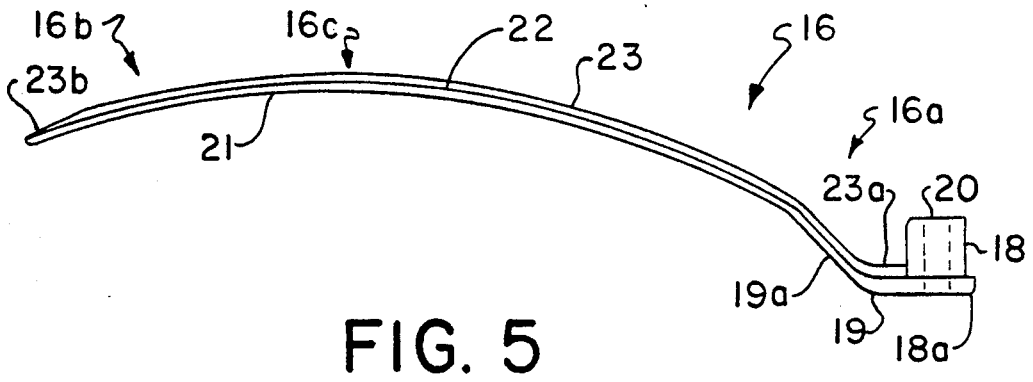
FIG. 5 is a side plan view of the front elongated member of the copyholder.
Figure 6:
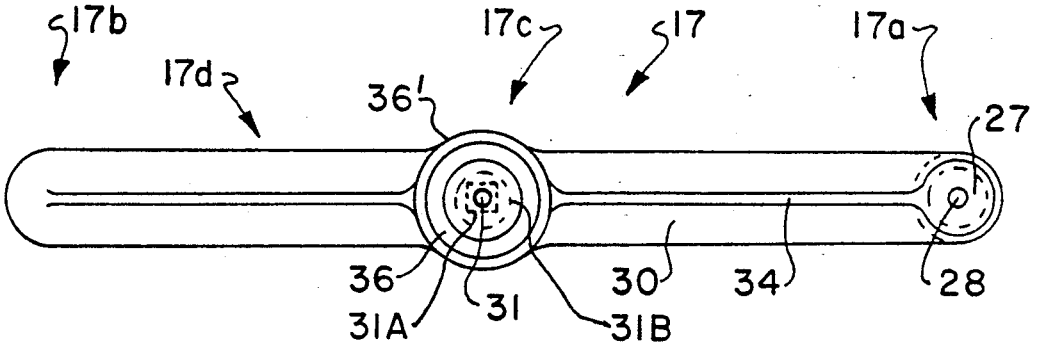
FIG. 6 is a rear elevation view of the rear elongated member of the copyholder.
Figure 7:
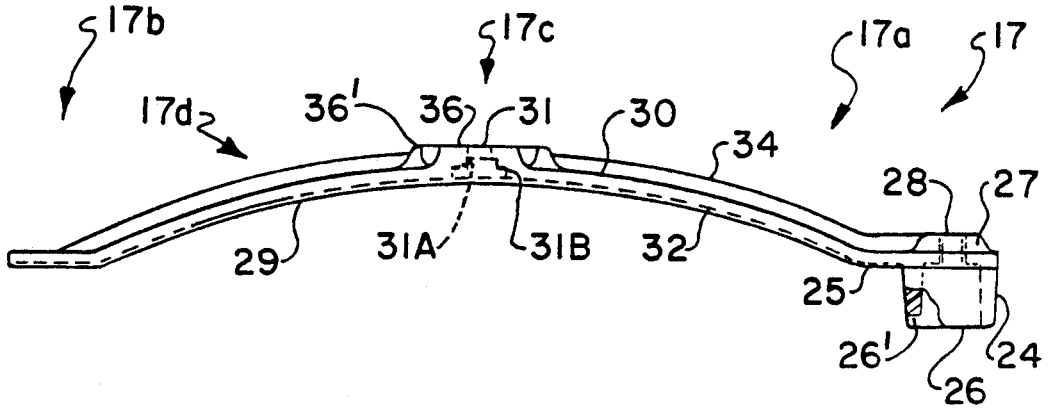
FIG. 7 is a side plan view of the rear elongated member of FIG. 6.
Figure 8:
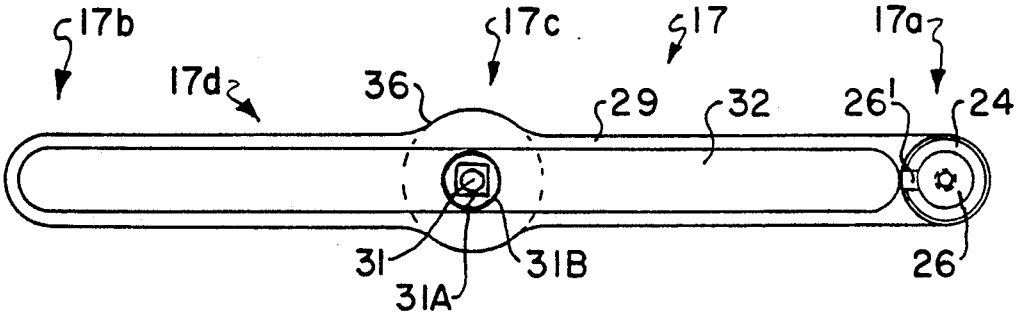
FIG. 8 is a front elevation view of the rear elongated member of the copyholder of FIG. 6.
Figure 9:
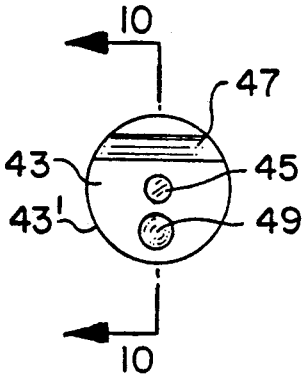
FIGS. 9–12 illustrate two disks which are used to mount the rear elongated member to a vertical support member.
Figure 10:
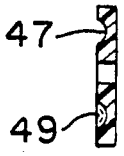
Figure 11:
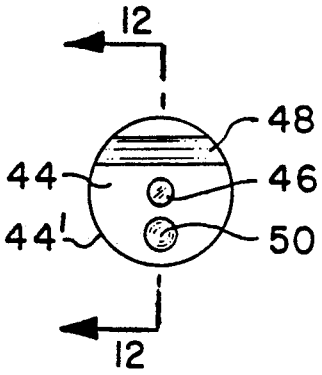
Figure 12:
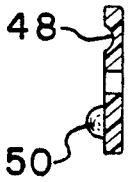

As shown in FIG. 4, extension 18 is placed inside extension 24. When extension 18 is initially inserted therein, the tip of front member 16 at second portion 16*b* will contact the tip of rear member 17 at second portion 17*b* before the remainder of body portion 16*c* contacts the remainder of body portion 17*d*. This is due to the orientations of body portions 16*c*, 17*d* with respect to extensions 18 and 24, respectively. As discussed above, body portion 16*c* is connected to extension 18 through neck portion 19 and connection portion 19*a*, which are connected to each other at an oblique angle. This oblique angle causes the orientation of body portion 16*c* with respect to extension 18 to be skewed as compared to the orientation of body portion 17*d* with respect to extension 24. This skewed orientation is apparent when FIGS. 5 and 7 are compared.

As extension 18 is further inserted in extension 24, the remainder of body portion 16*c* will contact and exert a biasing force against the remainder of portion 17*d*, with rib 23*a* engaging notch 26' to provide and maintain the appropriate alignment of front 16 and rear 17 elongated members. Also, bore 20 of extension 19 aligns with bore 28 of extension 24, with rib 23 of front member 16 contacting front surface 29 of rear member 17 and aligned in recess 32. A bolt 37 is then placed through bore 20 and threaded into bore 28 to maintain front member 16 and rear member 17 in this position. The head of bolt 37 is covered by a plastic cap 37A which is secured by a retaining ring 37B to give bolt 37 an aesthetically pleasing appearance. Due to the early initial contact of the tips of front and rear members 16 and 17, respectively, front member 16 will act as a spring-loaded member against rear member 17 to push paper 85 against surface 29. Thus, as shown in FIG. 1, a completely arcuate paper receiving slot 38 is formed between rib 23 and recess 32.

Slot 38 has a closed end portion 40 and an open end portion 42. Closed end portion 40 is defined by first end portion 17*a* of rear member 17, receptacle 25, and by first end portion 16*a* of front member 16. Closed end portion 40 therefore defines a gap in slot 38 that is wider than the remainder of slot 38. This gap provides flexibility to front member 16 and allows it to be pulled away from rear member 17, if desired. Open end portion 42, herein referred to as mouth 42, is defined by second end portion 17*b* of rear member 17 and by tapered end portion 23*b* of rib 23 of front member 16. Second end portion 17*b* is oriented in a direction away from the direction of curvature of rear member 17. Mouth 42 can easily receive paper 85 which can be simply introduced between members 16 and 17 by pulling the paper 85 into mouth 42 and toward closed end portion 40, which acts as a stop.

As shown in FIGS. 4 and 9–12, mounting assembly 12 comprises a first disk 43 having peripheral edge 43' and a second disk 44 having peripheral edge 44'. Disks 43, 44 preferably have the same diameter size as base 36. First and second disks 43, 44 each have a bore 45, 46, respectively, therethrough and elongated grooves 47, 48 on the respective surfaces thereof. First disk 43 further comprises a recess 49 that is on the same side as elongated groove 47, while second disk 44 further comprises a knob 50 that is configured and dimensioned to be received in recess 49. Knob 50 is on the same side as elongated groove 48.

As shown in FIG. 4 disks 43, 44 are first positioned facing each other, i.e., elongated grooves 47 and 48 and knob 50 and recess 49 are oriented towards each other, with knob 50 positioned to be received in recess 49. Accordingly, as shown in FIG. 1, elongated grooves 47, 48 are aligned with each other to form a channel 53.

Disks 43, 44 are then rotatably connected to rear elongated member 17 by passing an elongated rod or carriage bolt 51 through center bore 31 of rear member 17, through a nylon washer 54, and through bores 45, 46. Carriage bolt 51 is a well-known type of bolt that comprises a round head with a square protrusion positioned between the head and the threaded shank of the bolt. Washer 54 is preferably made of a thermoplastic material such as nylon and is manufactured by Product Components Corporation of Martinez, Calif.

Bolt 51 is preferably passed through center bore 31 before front member 16 is attached to rear member 17; however, if desired, bolt 51 may be passed therethrough afterwards by pulling front member 16 away from rear member 17. As discussed above, center bore 31 is recessed in rear member 17, and square recess 31A will non-rotatably maintain the square protrusion of bolt 51 therein to prevent bolt 51 from rotating. Further, head 52 of bolt 51 will be positioned in circular recess 31B to prevent head 52 from protruding out from front surface 29 and into slot 38. After bolt 51 has been positioned, edges 36', 43' and 44' will all be aligned with each other.

A second nylon washer 54A is then placed over the exposed end of bolt 51 and placed flush against the surface of disk 43. Nylon washer 54A is the same type of washer as washer 54, and they each provide a smooth transition from a tightened to untightened state of bolt 51. A standard metal washer 55 is then placed upon nylon washer 54, and a knob 57 with a nut 56 therein is then threaded onto bolt 51. Nut 56 is housed in knob 57 so that nut 56 may be hand-tightened onto bolt 51.

Preferably, knob 57 is made of a thermoplastic material such as ABS or nylon and is manufactured by O'-Connor Engineered Products, Inc. (OEP) of Wheeling, Ill. Knob 57 has a nylon ring therein (not shown) positioned behind nut 56 that locks itself onto the threaded shank of bolt 51 after bolt 51 is threaded through nut 56. Thus, knob 57 and nut 56 are self-locking and maintain nut 56 at a desired tightness on bolt 51. Alternatively, to insure that nut 56 remains at a desired tightness, the threads of bolt 51 may have a coating 59 applied thereto to make the threads self-locking. Preferably, coating 59 would comprise VIBRATITE adhesive manufactured by ND Industries of Wyckoff, N.J. VIBRATITE is a viscous material that makes hardware self-locking, self-sealing, and adjustable. Other similar locking adhesives such as nylon patch may be used if desired.

At this point nut 56 is not fully tightened onto bolt 51; nut 56 is merely tightened sufficiently to engage the tip of knob 50 with recess 49. Thus, if one of disks 43 or 44 is rotated, knob 50 in recess 49 will carry the other disk with the rotating disk. Consequently, elongated grooves 41, 42 will always remain in alignment.

As shown in FIG. 4, vertical support member 13 preferably comprises an L-shaped metal rod which comprises a body portion 13*a* and an end portion 13*b*. The diameter of the rod is slightly greater than the diameter of channel 53. After body portion 13*a* has been inserted into channel 53, nut 56 is tightened, thereby constricting elongated grooves 47, 48 around body portion 13*a* to maintain body portion 13*a* within channel 53. Thus, when rod 13 is secured within channel 53, grooves 47, 48 only partially surround the outer circumference of rod 13.

Nut 56 should only be tightened sufficiently to provide enough drag to hold front and rear members 16, 17 and mounting assembly 12 in position on rod 13 so that the position of the copyholder 10, as described herein in detail, can be adjusted. After positional adjustments to the copyholder are completed, with nut 56 tightened sufficiently for desired drag, rod 13 and knob 50 in recess 49 co-act to maintain disks 43, 44 parallel to each other.

Figure 13:
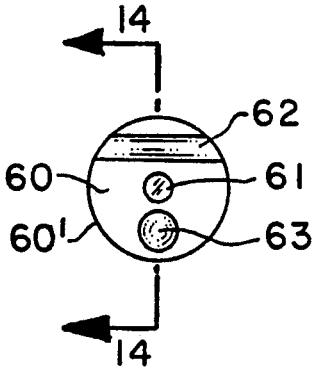
FIG. 13 is a front plan view of a disk for connecting the vertical support member to the base of the copyholder.
Figure 14:
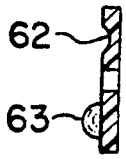
FIG. 14 is a cross-sectional view thereof taken along lines 14—14 of FIG. 13.

As shown in FIGS. 13 and 14, base connector assembly 14 includes disk 60 with peripheral edge 60', bore 61, elongated groove 62, and knob 63. Knob 63 is on the same side as elongated groove 62. The dimensions of disk 60 and its constituent parts are preferably substantially the same as those of disk 44.

Figure 15:
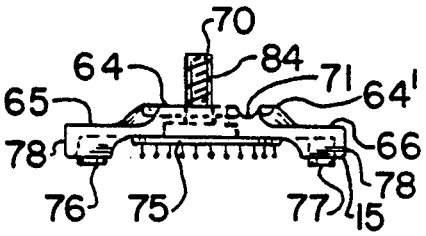
FIG. 15 is a side elevation view of the base of copyholder of the present invention.
Figure 16:
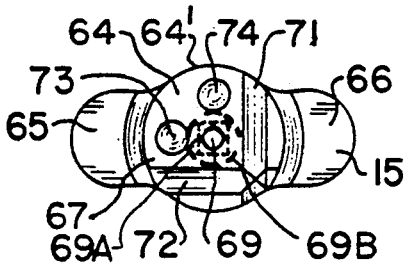
FIG. 16 is a top plan view of the base.
Figure 17:
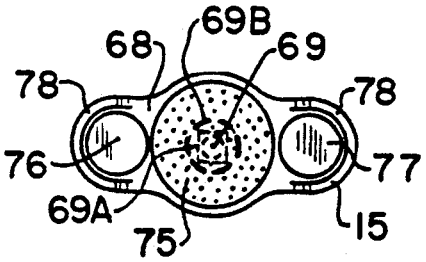
FIG. 17 is a bottom plan view of the base.

As shown in FIGS. 15–17, base 15 includes a central portion 64 with peripheral edge 64', two diametrically opposed appendages 65, 66 projecting away from central portion 64, a top surface 67, a lower surface 68, and a central bore 69. The diameter of central portion 64 is equal to the diameter of disk 60. Central bore 69 is set in a square recess 69A which, in turn, is set in a circular recess 69B. Bore 69 and recesses 69A and 69B are similar to bore 31 and recesses 31A and 31B of rear member 17 discussed above. Thus, an elongated rod or carriage bolt 70 may be inserted through central bore 69, and square recess 69A will non-rotatably maintain bolt 70 in bore 69. Further, circular recess 69B will prevent the head of bolt 70 from protruding out into lower surface 68.

Top surface 67 has two perpendicularly oriented elongated grooves 71, 72 and two recesses 73, 74 thereon. Preferably, the dimensions of grooves 71, 72 and recesses 73, 74 are substantially the same as the dimensions of groove 47 and recess 49 of first disk 43.

An attachment layer 75 is provided on lower surface 68. Attachment layer 75 completely covers recesses 69A and 69B and therefore retains bolt 70 in central bore 69. Preferably, attachment layer 75 comprises one side of a Type 170 DUAL LOCK fastener manufactured by 3M Company. However, it is also contemplated that attachment layer 75 comprise other types of removable attachment means such as one side of a VELCRO fastener or a magnet.

DUAL LOCK fasteners consist of a continuous plastic strip with mushroom shaped stems that are designed to engage together one with another DUAL LOCK fastener to provide recloseable fastening of one item to another. Type 170 DUAL LOCK has a stem pattern of approximately 170 stems/in$^2$ and is optimally mated with a Type 400 DUAL LOCK fastener, as disclosed herein in detail, so that they may be locked together in any position. The Type 170 DUAL LOCK is secured to lower surface 68 with a Type SJ-3542 pressure-sensitive adhesive backing. DUAL LOCK products with this adhesive are designed for general purpose kinds of dynamic and static load applications.

Alternatively, adhesive layer 75 may comprise a more permanent type of attachment means such as adhesive tape. If this type of attachment means were chosen, adhesive layer 75 would preferably comprise removable Twin Stick manufactured by Duraco, Inc. of Chicago, Ill. Twin Stick comprises a double-sided adhesive tape that has different bonding strengths on each side. The side of the Twin Stick with the greater bonding strength would be attached to lower surface 68 of base 15, while the side with the weaker bonding strength would face away from lower surface 68. Thus, base 15 could be mounted to a work surface for an extended period of time and then, if desired, be removed from the work surface by peeling base 15 away from the work surface. Since the bond between the adhesive tape and the work surface is weaker than the bond between the adhesive tape and lower surface 68, the adhesive tape will separate from the work surface before the adhesive tape separates from lower surface 68. Thus, the Twin Stick will remain intact and may be reattached to the work surface in a different position. Twin Stick has the advantage that it is less expensive than DUAL LOCK, but is not preferred because it may only be attached to and removed from a work surface a limited number of times.

Two cellular urethane pads 76, 77 are also secured to lower surface 68 of apertures 65, 66 by an adhesive or the like to provide stability to base 15. Preferably, pads 76, 77 comprise a thermoplastic or elastomeric material having a firm consistency. A foam known as PORON foam, product number 4701-12, is preferred because it has exceptional memory, or spring back capability, so that it does not lose its shape even after it has been deformed for an extended period of time. In general, PORON has a high density of 15-30 PCF (240-480 $kg/m^3$), is a microcellular opened celled urethane with an average cell size of approximately 100 microns, and may be cast to tight tolerances in precise thicknesses. PORON may also be formulated in a wide range of firmnesses and a variety of densities. PORON foam is manufactured by Rogers, Inc. of East Woodstock, Conn.

Lower surface 68 is slightly recessed in base 15, thereby providing base 15 with a peripheral rim 78. Preferably, the depth of the recess and therefore the height of rim 78 is approximately equal to the thickness of two sides or layers of the DUAL-LOCK connector when attached to each other and slightly less than the height of pads 76, 77. As shown in FIGS. 15 and 17, rim 78 may extend only around apertures 65, 66 to assist in the placement of pads 76, 77.

Bore 61 of disk 60 receives bolt 70, and knob 63 is positioned in either recess 73 or recess 74. The choice of recess 73 or 74 depends on the space restraints in the work area, as discussed herein in detail. When so positioned, edge 60' of disk 60 is aligned with edge 64' of central portion 64. Elongated groove 62 will also be aligned with either elongated groove 71, thereby forming a channel 79, or with elongated groove 72, thereby forming a channel 80. Channel 80 is not shown in the figures but is substantially identical to Channel 79 shown in FIG. 4. Channels 79 and 80 are configured to have a smaller diameter than that of rod portion 13*b*.

A nylon washer 81, similar to washers 54 and 54A described above, is then placed over the exposed end of bolt 70 and placed flush against the surface of disk 60. A knob 83 with a nut 82 therein is then threaded onto bolt 70. Nut 82 is housed in knob 83 so that nut 82 may be hand-tightened onto bolt 70. Knob 83 and nut 82 are similar to knob 57 and nut 56, which were described above in detail, and will maintain nut 82 at a desired tightness on bolt 70. Alternatively, to insure that nut 82 remains at a desired tightness, the threads of bolt 70 may have coating 84 applied thereto to make them self-locking. Coating 84 may also comprise VIBRATITE adhesive or nylon patch.

At this point nut 82 is not fully tightened onto bolt 70; nut 82 is merely tightened enough so that the tip of knob 63 is engaged with recess 73 or 74. Thus, disk 60 is maintained non-rotatable with respect to base 15 so that channel 79 or 80 cannot be disturbed.

Second portion 13*b* of rod 13 is then inserted into channel 79 or 80. Nut 82 is then tightened further, thereby constricting elongated grooves 62 and 71 or 62 and 72 around second portion 13*b* to maintain second portion 13*b* within channel 79 or 80. Rod 13 is dimensioned such that when it is placed within channel 79 or 80, grooves 62 and 71 or 62 and 72 only partially surround the outer circumference of rod 13, and, when nut 82 is tightened, rod 13 and knob 63 in recess 73 or 74 maintain disk 60 parallel to base 15.

Nut 82 must not be overtightened on bolt 70 or copyholder 10 will be difficult to adjust. Nut 82 should only be sufficiently tight to provide enough drag to hold rod 13 in a desired position within channel 79 or 80 while still allowing a full range of adjustment of copyholder 10.

After copyholder 10 is assembled and bolts 51 and 70 are sufficiently tightened, copyholder 10 is attached to a desk or tabletop, or any other work surface, with attachment layer 75. As discussed above, attachment layer 75 preferably comprises one side of a type 170 DUAL LOCK tape connector, and it is attached to a mating piece of Type 400 DUAL LOCK tape connector 75*a*. Type 400 DUAL LOCK has a dense stem pattern of 400 stems/$in^2$, and had previously been secured to the work surface with a Type SJ-3541 pressure sensitive adhesive backing. This adhesive backing is also designed for general purpose kinds of dynamic and static load applications. Thus, copyholder 10 is easily detachable from the work surface to be transported to a different work station.

A sheet of paper 85 may then be inserted into slot 38 through mouth 42. Because of the open configuration of mouth 42, front member 16 does not have to be pulled away from rear member 17 to insert paper 85 into slot 38. Thus, paper 85 may quickly and easily be slid into slot 38 using only one hand.

Because of the arcuate shape of front and rear elongated members 16 and 17, respectively, paper 85 will remain rigid and self-supportive in copyholder 10. Further, as shown in enlarged detail in FIG. 3, rib 22 of front member 16 and recess 32 in front member 17 coact to slightly bend paper 85. This bend in paper 85 maintains the paper in its proper vertical position in copyholder 10; i.e., paper 85 will not slip or slide down between front and rear members 16, 17 and will not fold over onto itself due to the arcuate shape of those members. Further, the spring-like biasing of front member 16 against rear member 17 will assist in maintaining paper 85 in its proper vertical position.

Figure 18:
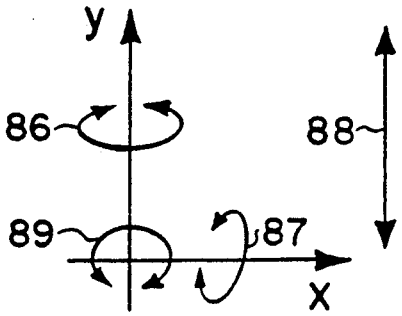
FIG. 18 is a schematic illustrating some of the directions of movement that the copyholder can provide.

Copyholder 10 may then be adjusted in at least six different directions so that paper 85 will be held at a convenient viewing angle. As discussed above, bolt 51 is only tight enough to provide enough drag to maintain paper holder il and mounting assembly 12 in position on rod 13. Thus, paper holder 11 may be adjusted into a convenient viewing angle by rotating it around support member 13, as shown by arrow 86 in FIGS. 1 and 18. The rotation shown by arrow 86 is provided by channel 53 in disks 43, 44 surrounding most of rod 13. Further, paper holder 11 may be adjusted by rotating it in a direction perpendicular to the direction shown by arrow 86. This rotation is shown by arrow 87 and is provided by bolt 51 extending through center bore 31 in rear member 17 and bores 45, 46 in disks 43, 44, respectively. The rotations shown by arrows 86 and 87 are completely free and unhindered; i.e., paper holder 11 may be rotated a full 360° in either direction without obstruction.

In addition, paper holder 11 may be adjusted vertically on support member 13, as shown by arrow 88. This adjustment is provided by channel 53 in disks 43, 44, surrounding most of rod 13. The motion shown by arrow 88 is also completely free and unhindered; i.e., paper holder 11 may be slid along the entire length of first portion 13*a* of rod 13.

As discussed above, bolt 70 is only tight enough to provide enough drag to hold rod 13 in a desired position within channel 79 or 80. The use of either channel 79 or 80 is left to the discretion of the user of the copyholder, and usually depends on the particular space restraints imposed on the user. For example, if a secretary's desktop only provides enough room to allow base 15 to be attached with apertures 65, 66 side by side, then channel 80 would be used. However, if apertures 65, 66 must be in a straight line; i.e., one in front of the other, then channel 79 would be used. If neither of these two orientations are acceptable, the secretary can attach base 15 in an intermediate orientation, and then compensate for any offset of paper holder 11 by rotating paper holder 11 in the direction shown by arrow 86.

Whether channel 79 or 80 is chosen, paper holder 11 may be further adjusted into a convenient viewing position by adjusting the angle of rod 13 with respect to the horizontal by movement of rod 13 in channel 79 or 80 in either of two opposite directions. In the first direction, paper holder 11 may be moved toward or away from the user by rotating rod 13 about base 15. This motion is shown by arrow 89 in FIG. 1, and is provided by rotation of rod 13 in channel 79 or 80.

In the second direction, paper holder 11 may be adjusted toward or away from base 15, and thus towards or away from the typewriter or computer, by sliding rod 13 along channel 79 or 80. This motion is shown by arrow 90.

Accordingly, by adjusting copyholder 10 in the directions shown by arrows 86–90, copyholder 10 may be positioned to hold paper 85 at an optimum viewing angle. Thus, users may mount copyholder 10 on a horizontal, vertical, or any other work surface and adjust the position of paper 85 to avoid neck and back aches, eye strain, and to compensate for changing lighting conditions during the day. Further, since copyholder 10 is relatively small, it is easily transportable and will not occupy much valuable space on a work surface.

According to the provisions of the Patent Statues, I have explained the principle, preferred construction and mode of operation of my invention and have illustrated and described what I now consider to represent its best embodiments. However, it should be understood, that within the scope of the appended claims, the invention may be practiced otherwise than as specifically illustrated and described.

What is claimed is:

1. A copyholder for positioning a sheet of paper at a desired viewing angle, comprising:

means for holding a sheet of paper wherein the holding means comprises complementary front and rear elongated members each having an arcuate shape and being configured and dimensioned to define a slot therebetween for receiving paper therein, and means for aligning the front and rear members in a predetermined orientation, wherein the aligning means comprises a tubular extension associated with the front member and a tubular extension associated with the rear member, wherein one of the tubular extensions is configured and dimensioned to receive at least a portion of the other tubular extension therein, and means for retaining the tubular extensions in contact with each other, thus placing the front and rear elongated members in adjacent relation;

first means for rotating the holding means in a first plane;

second means operatively associated with the first means for rotating the holding means in a second plane which has a fixed angular disposition with respect to the first plane; and means operatively associated with the first means for mounting the holding means in any one of a plurality of vertical positions, said first and second rotating means capable of rotating without obstruction from the mounting means.

2. The copyholder of claim 1 further comprising a rod member for supporting the holding means and having first and second rod portions forming an angle therebetween with the first rod portion being longer than the second rod portion.

3. The copyholder of claim 2 wherein the first rotating means comprises an assembly which forms a channel surrounding and rotatably associated with the first rod member portion.

4. The copyholder of claim 2 wherein the second rotating means comprises an elongated rod which passes through a central portion of the holding means and facilitates rotation of the holding means therearound.

5. The copyholder of claim 4 which further comprises a fastener component which engages an end of the elongated rod which passes through the holding means and through the first and second rotating means.

6. The copyholder of claim 2 further comprising a base for mounting to a support surface and for receiving at least a portion of the second rod portion.

7. The copyholder of claim 6 further comprising means for pivoting the first rod portion to any one of a plurality of desired angles with respect to the support surface.

8. The copyholder of claim 7 wherein the pivoting means comprises means for retaining the second rod portion upon the base, wherein the retaining means and the base each includes a groove for forming a channel that surrounds the second rod portion and allows both sliding and rotational movement of the second rod portion therein.

9. The copyholder of claim 8 wherein the base includes at least two grooves for forming channels with the retaining means in at least two different positions.

10. The copyholder of claim 6 further comprising means for releasably attaching the base to the support surface.

11. The copyholder of claim 10 wherein the base includes means for stabilizing the attaching means.

12. The copyholder of claim 11 wherein the attaching means comprises a first surface member attached to one of the base or support surface and a second surface member attached to the other of the base or support member, wherein the first and second surface members are engageable when placed in contact to form a secure but releasable connection therebetween.

13. The copyholder of claim 1 wherein the support surface can be horizontal or vertical.

14. The copyholder of claim 1 wherein the front elongated member is biased against the rear elongated member, thereby acting as a spring-loaded member that pushes against the rear elongated member.

15. The copyholder of claim 1 wherein the slot is formed by a rib portion extending from one of the front or rear elongated members towards the other and a groove on the other elongated member for receiving the rib portion therein.

16. A copyholder for positioning a sheet of paper at a desired viewing angle comprising:

means for holding a sheet of paper wherein the holding means comprises complementary front and rear elongated members each having an arcuate shape and being configured and dimensioned to define a slot therebetween for receiving paper therein, and a means for aligning the front and rear members in a predetermined orientation, wherein the aligning means comprises a tubular extension associated with the front member and a tubular extension associated with the rear member, wherein one of the tubular extensions is configured and dimensioned to receive at least a portion of the other tubular extension therein, and means for retaining the tubular extensions in contact with each other, thus placing the front and rear elongated members in adjacent relation;

first means for rotating the holding means in a first plane;

second means operatively associated with the first means for rotating the holding means in a second plane which has a fixed angular disposition with respect to the first plane;

means operatively associated with the first means for mounting the holding means in any one of a plurality of vertical positions;

a rod member for supporting the holding means and having first and second rod portions forming an angle therebetween with the first rod portion being longer than the second rod portion; and a base for mounting to a support surface and for receiving at least a portion of the second rod portion.

17. The copyholder of claim 16 wherein the first rotating means comprises an assembly which forms a channel surrounding and rotatably associated with the first rod member portion.

18. The copyholder of claim 17 wherein the second rotating means comprises an elongated rod which passes through a central portion of the holding means and facilitates rotation of the holding means thereabout.

19. The copyholder of claim 18 wherein a fastener component engages an end of the elongated rod which passes through the holding means and through the first and second rotating means.

20. The copyholder of claim 19 wherein the first and second rotating means and the mounting means forms a rotatable mounting assembly comprising first and second disk members each having a groove on one surface thereof, wherein the grooves face each other to form a channel which surrounds the first rod portion and allows both sliding and rotational movement of the first rod portion therebetween.

21. The copyholder of claim 20 wherein the fastener component is a retaining nut, the elongated rod is threaded, and the rotatable mounting assembly further comprises said disks, said retaining nut and said threaded rod, which when engaged with the retaining nut connects the rear elongated member and the first and second disks, together with the channel surrounding the first rod portion for placement thereon.

22. The copyholder of claim 20 wherein the first and second disk members each include registration means comprising an aperture in combination with a protuberance on one of said disks with a mating depression in the other.

23. The copyholder of claim 21 wherein said retaining nut is associated with a knob for controlling the connection force exerted by the engagement of the nut with the threaded rod.

24. A copyholder for positioning a sheet of paper at a desired viewing angle, comprising:

means for holding a sheet of paper wherein the holding means comprises complementary front and rear elongated members each having an arcuate shape and being configured and dimensioned to define a slot therebetween for receiving paper therein, and a means for aligning the front and rear members in a predetermined orientation, wherein the aligning means comprises a tubular extension associated with the front member and a tubular extension associated with the rear member, wherein one of the tubular extensions is configured and dimensioned to receive at least a portion of the other tubular extension therein, and means for retaining the tubular extensions in contact with each other, thus placing the front and rear elongated members in adjacent relation;

first means for rotating the holding means in a first plane;

second means operatively associated with the first means for rotating the holding means in a second plane which has a fixed angular disposition with respect to the first plane;

means operatively associated with the first means for mounting the holding means in any one of a plurality of vertical positions;

a rod member for supporting the holding means and having first and second rod portions forming an angle therebetween with the first rod portion being longer than the second rod portion;

a base for mounting to a support surface and for receiving at least a portion of the second rod portion; and means for pivoting the first rod portion to any one of a plurality of desired angles with respect to the support surface.

25. The copyholder of claim 24 wherein the pivoting means comprises means for retaining the second rod portion upon the base, wherein the retaining means and the base each includes a groove for forming a channel that surrounds the second rod portion and allows both sliding and rotational movement of the second rod portion therein.

26. The copyholder of claim 25 wherein the base includes at least two grooves for forming channels with the retaining means in two different positions.

27. The copyholder of claim 25 wherein the retaining means comprises a disk member, a retaining nut and a threaded elongated rod which, when engaged with the retaining nut connects the base and the disk member together with the channel surrounding the second rod portion.

28. The copyholder of claim 27 wherein the base and the disk member include registration means comprising an aperture in combination with a protuberance in one of the base and the disk member with a mating depression in the other.

29. The copyholder of claim 27 wherein said retaining nut is associated with a knob for controlling the connection force exerted by the engagement of the nut with the threaded rod.

30. The copyholder of claim 24 further comprising means for releasably attaching the base to the support surface.

31. The copyholder of claim 30 wherein the base includes means for stabilizing the attaching means.

32. The copyholder of claim 31 wherein the attaching means comprises a first surface member attached to one of the base or support surface and a second surface member attached to the other of the base or support member, wherein the first and second surface members are engageable when placed in contact to form a secure but releasable connection therebetween.

* * * * *